US005593956A

United States Patent [19]

Gzesh

[11] Patent Number: 5,593,956

[45] Date of Patent: Jan. 14, 1997

[54] DRY WIRE DRAWING LUBRICANTS

[75] Inventor: David P. Gzesh, Lisle, N.Y.

[73] Assignee: Elf Atochem North America, Inc., Philadelphia, Pa.

[21] Appl. No.: 597,651

[22] Filed: Feb. 7, 1996

Related U.S. Application Data

[63] Continuation-in-part of Ser. No. 400,688, Mar. 8, 1995, abandoned, which is a continuation of Ser. No. 46,042, Apr. 9, 1993, abandoned, which is a continuation-in-part of Ser. No. 34,926, Mar. 19, 1993, abandoned, which is a continuation-in-part of Ser. No. 889,027, May 26, 1992, abandoned.

[51] Int. Cl.[6] ..... C10M 129/26

[52] U.S. Cl. ..... 508/459; 72/42

[58] Field of Search ..... 252/18; 72/42

[56] References Cited

U.S. PATENT DOCUMENTS

| | | | |
|---|---|---|---|
| 2,956,017 | 10/1960 | Franks | 252/18 |
| 3,961,511 | 6/1976 | Wolfe | 72/42 |
| 4,068,513 | 1/1978 | Guerit et al. | 72/42 |
| 4,308,182 | 12/1981 | Eckard et al. | 252/18 |
| 4,404,828 | 9/1983 | Blachford | 72/42 |
| 4,553,416 | 11/1985 | Sudoh et al. | 72/42 |

FOREIGN PATENT DOCUMENTS

| | | |
|---|---|---|
| 1006497 | 3/1977 | Canada . |
| 0169382 | 1/1986 | European Pat. Off. . |
| 55-011157B | 3/1980 | Japan . |
| 1123753A | 11/1984 | U.S.S.R. . |

OTHER PUBLICATIONS

R. Platt, "Wire Technology", pp. 17–18 (1989) month unavailable.

The Wire Association International, Inc., "Ferrous Wire", vol. 1, pp. 363–375 Date Unavailable.

Product Data Sheet—Chemdraw—Diapel 2000 Date Unavailable.

*Primary Examiner*—Jacqueline V. Howard

*Attorney, Agent, or Firm*—Stanley A. Marcus; William D. Mitchell

[57] ABSTRACT

Shaped, dust-free dry wire drawing compound lubricants having at least one reproducibly controlled dimension and methods for their preparation comprising the steps of conglutinating and pressure forming the lubricant composition.

15 Claims, No Drawings

DRY WIRE DRAWING LUBRICANTS

CROSS-REFERENCE TO RELATED APPLICATION

This is a continuation-in-part of application Ser. No. 08/400,688 filed on Mar. 8, 1995, (abandoned), which in turn is a continuation of application Ser. No. 08/046,042 filed on Apr. 9, 1993 (abandoned), which in turn is a continuation-in-part of application Ser. No. 034,926 filed on Mar. 19, 1993 (abandoned), which in turn is a continuation-in-part of application Ser. No. 07/889,027 filed on May 26, 1992 (abandoned).

FIELD OF THE INVENTION

The present invention relates to dust-free, dry wire drawing compounds, and processes for their manufacture, particularly to dry wire drawing compound lubricants characterized as dry, free-flowing, non-powdery, non-dusty, compositions and constructions having at least one reproducibly controlled dimension which form viscous lubricating films directly or after reduction in size.

BACKGROUND OF THE INVENTION

Wire drawing is a process employed to produce wire from rod by pulling the rod and wire through one or more dies in order to reduce the cross-sectional area until a final product of the desired cross-section is achieved.

"Rod" is a term used to denote hot-rolled, undrawn stock used in the wire drawing process. "Wire" is the term used to denote the product of drawing, i.e., rod which has been reduced in cross-sectional area.

Dies used in the wire drawing process must be of sufficient hardness to withstand the pressure, heat, and abrasiveness developed by the wire passing through the die. Most wire drawing dies are constructed of special alloys such as tungsten-carbide or similar hard materials or alternatively, the die surfaces, which may contact the moving wire, are coated with thermally stable, abrasion resistant coatings. Direct contact between the die surface and the moving wire surface must be kept to a minimum, or preferably prevented entirely, in order to maintain the desired surface characteristics of the wire and prevent excessive die wear and damage.

Typical dies designed for wire drawing operations consist of four zones which may be described as follows: Zone 1, or the approach zone, consists of a circumferential angular opening encircling the moving wire which allows the wire drawing lubricant to enter the die. The angle of the approach zone's interior surface, relative to the moving rod or wire surface, is typically 6 degrees to 25 degrees. The selection of approach zone angle depends on the size and composition of the wire to be drawn, draw speed, number of reductions required, and lubricant formulation and physical form. The lubricant must be in a form which allows it to enter the approach zone along with the wire. Zone 2, or reduction zone, is the location within the die in which plastic deformation of the rod or wire occurs. It is in Zone 2 that reduction of cross-sectional area is achieved during drawing. Zone 2 is a continuous extension of Zone 1, encircling the moving wire. The angle of the interior surface of Zone 2 relative to the moving wire determines both the degree of cross-sectional reduction and is a major factor in controlling the thickness of the wire drawing lubricant film which remains on the wire surface as it exits the die. This residual lubricant is essential when a number of dies are used in a series to effect multi-step cross-sectional reductions. Zone 3 is referred to as the bearing zone. It serves principally to assure final shaping of the wire. Zone 4 is the pressure relief zone. Pressure developed between the wire and die surfaces can reach many thousands of pounds per square inch during the drawing operation. It is necessary that this pressure be released at the die exit in a manner which avoids damage to the die. Without a pressure relief zone, cracking of the die can occur.

Dies may be used in combination with a single die stand. These are referred to as pressure dies and are designed to increase the pressure on the wire drawing lubricant in order to force additional lubricant onto the surface of the wire and thus increase the residual lubricant film thickness.

As noted above, it is essential that the rod or wire be prevented from coming in contact with the die surface during wire drawing. This is accomplished by maintaining a continuous film of lubricant between the die surface and the surface of the moving wire. When dry wire drawing lubricants are used, the rod or wire is pulled continuously through a bed of dry wire drawing lubricant contained in a "soap box" or "die box." The soap box has an entry port and an exit port through which the wire passes. The exit port of the soap box is comprised of a first die located such that the die is below the surface level of the wire drawing compound contained in the soap box. Periodic additions of wire drawing compound are made to the soap box to assure that its first die is always submerged in wire drawing compound.

When a series of dies are employed for multi-step reductions, there may be additional soap boxes associated with specific dies. The purpose of these additional boxes is to supply additional surface lubricant coating to the wire if needed.

The wire being pulled through the die system travels at speeds of a few feet per minute, up to thousands of feet per minute, depending on the die system, wire composition, cross-sectional area reduction required, cooling capacity, and lubrication available. At these high speeds it is necessary that the undrawn rod surface be roughened so that lubricant in sufficient quantity will adhere to the surface and be carried into the die. Roughening of the rod may be accomplished by applying chemical coatings to the rod prior to its introduction into the wire drawing system. The most common coating compositions are based on lime, borax, or phosphates. The resultant rough coating is commonly referred to as a "lubricant carrier" coating.

Mechanically descaled rod may be sufficiently rough without further coating or, if necessary, may be roughened with additional mechanical treatment. Lubricant applicators can be used to force lubricant onto the rod surface by pressure.

The dry wire drawing compound lubricants must flow freely in the soap box in order that fresh lubricant be exposed to the moving wire. If the wire drawing compound fails to move freely by gravitational force or mechanical agitation in the soap box, it will compact into a dense mass through which the moving wire will form a channel. This is a condition known as "tunneling." Once tunneling occurs, there is a loss of contact between the wire and the dry lubricant and, as a result, the die system is starved for lubricant and damage to the wire and die surface will occur.

As the dry wire drawing compound lubricant enters the die at the approach zone, it is converted by heat and/or pressure into a film of plastic-like consistency. If converted to a liquid, it would offer little, if any, protection against the wire moving laterally through it and contacting the die surface. Further, the majority of a liquid lubricant applied to the wire in this type of drawing system would be lost immediately upon exiting the die and would not be available as residual lubricant for protection of other dies in a multi-die system.

The composition of the dry wire drawing compound lubricants has been discussed widely in the patent and technical literature, some examples of which are set forth hereinafter in the detailed description. In a broad sense, dry wire drawing compounds are typically based on a combination of fatty acid soaps, excess base or free fatty acid, and, as required for specific applications, various thickeners, pressure additives, pigments, fillers, and thermal stabilizers. The most commonly used dry wire drawing compound lubricants are based on calcium soaps or sodium soaps. A manufacturer of dry wire drawing compound lubricants typically offers several hundred different formulations, each designed to satisfy the technical requirements of specific wire drawing applications.

Historically, dry wire drawing compound lubricants have been produced as fine powders in order to meet the stringent requirements of the wire drawing process. However, these powdered materials are very dusty, lending to worker irritation and unclean work areas.

Various approaches have been tried to alleviate the dust problems associated with dry wire drawing compound lubricants. These include tableting, extruding, flaking, beading, and wetting. None, however, have been totally successful.

Wetting of the compound with a liquid to suppress dustiness introduces a non-active diluent which frequently has a deleterious effect on one or more essential properties of the lubricant, such as lowering of the melt point or reduction in free flowability.

"Beading" is a process of manufacturing dry wire drawing compound lubricants disclosed in Canadian Patent 1,006,497. Although this patent discloses a composition which is "essentially dust-free," it states that "the presence of fines in minor amounts . . . can be tolerated without loss of operating efficiency." In practice, these beaded compositions are less than completely dust free as would be expected from the presence of fine particles. Removal of the fines by screening or washing would add costly manufacturing steps. Further, the beads formed by rolling are not uniform in dimension in any direction, resulting in separation during shipment and use.

Flaking of dry wire drawing compound lubricants by casting a molten mass of the lubricant onto a chill roll is essentially ineffective. The resultant flakes are too large, typically one-half inch in diameter (12 mm), to perform effectively in wire drawing systems. Grinding of the flakes to produce smaller particle size invariably leads to production of a fine powder fraction and dust.

Tableting is an expensive process and, again, the particle size, typically one-quarter inch in diameter (6 mm) or greater, is unsatisfactory.

Extruding of dry wire drawing compounds on conventional screw extruders, operated in a conventional manner, such as are used in making pelletized plastics or plastic additives has been tried in the dry wire compound lubricant industry without success. While the pellets produced were dust free, the work energy required to form them hardened the pellets so that they would not melt or reduce to useful size in the wire drawing process.

It is completely surprising that the process of the instant invention solves all of the problems of previous attempts at making effective, dust free, dry wire drawing compound lubricants, especially since no permanent additional additives such as water-soluble binders which could interfere with or change the lubrication properties of the dry wire drawing compound lubricants are required.

SUMMARY OF THE INVENTION

This invention pertains to a method for the manufacture of dust-free, dry wire drawing compound lubricants and metal soap compositions having at least one reproducibly controlled dimension which possess all of the beneficial properties of powdered lubricants and none of the undesirable properties of powders, such as dust generation. The process comprises the steps of conglutinating and shaping the dry wire drawing compound composition under controlled pressure. The conglutinating and shaping steps may be performed sequentially or simultaneously.

Materials used as raw materials in the process are dry wire drawing compounds, usually in powder form, comprising metal soaps, unreacted basic compounds, free fatty acids, and, as required for specific applications, minor amounts of various adjuvants such as fillers, pigments, dyes, extreme pressure additives, stabilizers, thickeners, waxes and polymers, esters, ethoxylates and metal wetting agents.

A wide range of temperature can be employed in the pressure forming step, with the restriction that it is below the melt point of the metal soap component of the dry wire drawing composition. At least one dimension of the shaped article formed by the pressure forming step is reproducibly uniform.

A wide range of forming pressure energy may be employed with the proviso that it be no greater than the energy later required to reduce the product of the process to smaller particles during use by pulverizing, softening, or melting.

The most preferred application for the novel products of the invention is in wire drawing through stationary or roller dies. As used herein terms such as "dust free" or "non dusting" refer to the shaped wire drawing compound constructions which are essentially free of dustable particulates as formed. Minor amounts of dustable particulates may be generated during cutting operations to form the construction to the desired length(s), but these may be readily removed, typically by exposing the construction to a vacuum during the cutting operation.

DETAILED DESCRIPTION OF THE INVENTION

A method has now been discovered for the production of conglutinated and shaped dust-free dry wire drawing lubricant compounds, the shaped lubricant compound products thus obtained having at least one reproducibly controlled dimension. The method may be carried out using a variety of equipment such as screw extruders, roller extrusion presses, or roller presses. The grinding action which occurs in pellet production on pellet presses, whether on stationary dies with rotating roller pressure or rotating dies with stationary roller pressure, effectively reduces agglomerates resulting in a more uniform wire drawing compound product which in turn results in more uniform coating on the wire.

The dry wire drawing lubricant compounds useful in this invention have been widely described in the literature such as the following, each of which is incorporated herein by reference. One such publication, an article by Richard Platt titled "Choosing a Powdered Lubricant for Ferrous Wire Drawing" in Wire Technology, May, 1989, discusses the general composition of dry wire drawing lubricant and provides a table of properties relating the composition to residual film thickness. Another article titled "Lubrication of Ferrous Wire" in Ferrous Wire, Volume 1, "The Manufacture of Ferrous Wire," published by the Wire Association International, Inc., discusses various types of lubricants, their proper selection, and some of the terminology—thus, the industry accepted terms descriptive of the lubricants which leave a thick residual film on the wire is "lean," while those leaving a thin film are referred to as "rich." The "rich" lubricants are higher in fatty acid content than the "lean" lubricants. A further classification discussed by Platt divides the dry wire drawing compounds into soluble sodium soap compounds and insoluble calcium soap compounds. A "lean" soap formulation typically contains 30% fatty acid while a "rich" soap formulation typically contains 70% fatty acid. Both of these articles disclose that other additives may be present to help maintain viscosity during the drawing process, to act as extreme pressure lubricants, to provide anti-corrosion characteristics, and to add color. U.S. Pat. No. 2,956,017 (Franks) discloses calcium soap compositions useful in dry wire drawing compounds. Franks further notes that combination of the calcium soaps with diamide waxes is beneficial. U.S. Pat. No. 4,404,828 (Blatchford) discusses the wire drawing process utilizing dry wire drawing lubricant powders, the classification and composition of dry wire drawing powdered lubricants, the dust problem associated with powdered lubricants, and so on.

The dry wire drawing lubricant compounds useful with the present invention are those which are based on metal soaps, particularly calcium soaps and sodium soaps as described in the aforementioned references, that is, those lubricants which are essentially free of elemental tin and which preferably have a fatty acid content of at least about thirty percent (30%) by weight. The process described herein is also beneficial in the reprocessing of "spent" wire drawing compounds—that is, those materials which have been rejected by the die system or have passed through the die or dies and have become separated from the wire. They may be unchanged in chemical composition or modified by heat exposure, metal pick up or other forms of contamination. Such materials are frequently in the form of scales or flakes, string like materials or powder. These spent materials may be recovered by vacuum systems, for example, and reprocessed alone or blended with virgin wire drawing compound to produce satisfactory shaped constructions of dry wire drawing compounds, frequently without intermediate purification steps.

The method of the invention comprises the steps of (A) conglutinating the dry wire drawing lubricant composition and (B) shaping the conglutinated product under controlled pressure to provide a dust-free shaped lubricant product having at least one reproducibly controlled dimension, pulverizable by the wire drawing process. Steps A and B can be carried out sequentially or simultaneouly.

"Conglutination" is a term used to describe the process of sticking together a mass of individual particles as though glued together. The conglutinating "agent" is a combination of heat and pressure, with or without water being present. If water is present, it may be water remaining in the metal soap composition generated during the reaction of the metal hydroxide with the fatty acid or it may be added to the process, for example, at the pressure forming step. If water is present it will normally be present in the range of from about 0.5 to about 10.0 weight percent of the finished product weight. The maximum water present in any given composition of wire drawing compound is dependent on the end use of the wire drawing compound and varies with the wire composition, process configuration, and wire speed.

Elevated temperatures may be employed to facilitate conglutination and pressure forming to the desired shape and physical strength of the finished product. Elevated temperatures used in the process will be below the melt point of the metal soap used in the dry wire drawing lubricant. Preferred temperatures range from about 50 to about 120 degrees Centigrade, most preferably 70–90. These elevated temperatures refer to the temperature of the dry wire drawing compound composition as it enters the forming equipment or present in the forming equipment. The elevated temperatures of the lubricant composition may be residual heat from the soap forming step or may be added by exposing the composition to elevated temperatures or by supplying heat to those portions of the forming equipment which contact the dry wire drawing compound during forming. Where the pressure forming equipment comprises a portion of a continuous process, the residual heat of the soap production is used beneficially. Pellets exiting the die plate may be advantageously cooled by passing air across them to lower their temperature and minimize sticking to each other or to surfaces of the process equipment. These exiting pellets may also be subjected to a vacuum, at or close to the cutter bar which cuts the pellets to the desired length, in order to reduce or eliminate fine particles which may be generated during the cutting or breaking action.

The pressure to be applied to the conglutinated or conglutinating product to form the shaped, dust-free dry wire drawing compound covers a wide range and is determined by the metal soap composition of the dry wire drawing compound, the strength required for the shaped articles to withstand the rigors of shipping and handling and still be useful in wire drawing, and the process forming equipment being used. It is also influenced by the temperature being employed and by the presence or absence of water. It is the physical strength required of the final shaped product which determines how much pressure is to be used. For example, pellets (or other constructions) of dry wire drawing compound produced by the process of this invention should be strong enough to resist breakage or deterioration to powder during shipping and handling (generally able to withstand pressures of at least about 10 pounds per square inch, preferably at least about 20 pounds per square inch) but pulverize readily when in contact with the moving wire (generally satisfactory if pulverizable at a pressure below about 300 pounds per square inch, preferably below about 135 pounds per square inch). It is essential that such pellets be reduced in size rapidly during the wire drawing operation in order that they can enter the approach zone of the die where softening and melting to a plastic film begins. Some pellets, particularly those below 1 mm diameter, can enter the approach zone or go directly into the melt without pulverizing.

While the action of the wire moving through the pellets in the soap box is the primary force which pulverizes the pellets, it may be desirable at initial startup of a wire drawing line to add a small amount of pulverized wire drawing compound to the soap box to insure complete coating of the wire prior to the pulverization process reaching equilibrium. Another means of accomplishing this is to use lubricant applicators which are well known in the art for breaking up lubricants and forcing the powder onto the wire.

A particular advantage of the shaped constructions of wire drawing compounds described herein is that they form a "blanket" over pulverized material in the soap box. The larger shaped constructions rise to the top of the soap box while the pulverized materials remain at the bottom of the soap box surrounding the wire. This blanketing action suppresses the release of finely pulverized wire drawing compound to the atmosphere. A further advantage of these shaped constructions is that the coatings deposited on the wire are more uniform than those produced using conventional powdered wire drawing compounds, possibly due to segregation of powdered material into non-homogeneous layers during shipping and handling; the uniformly coated wire in turn is easier to process in post drawing operations.

The shaped dust-free wire drawing lubricants produced by the inventive process may be produced in a wide variety of shapes, such as cubes, balls, cylinders, pellets, or flakes. It is, however, essential that at least one dimension be reproducibly controlled and not be so large as to be unusable in the wire drawing operation. In general, large diameter wire can be processed with large or small constructions of shaped wire drawing lubricants produced by the inventive process, while small diameter wire will normally require smaller constructions of wire drawing compounds. A typical size for products of this invention which can be used successfully in wire drawing is one having a diameter or thickness of from about 0.5 to about 10 mm. All other dimensions will be approximately 5–7 times the controlled dimension, or less.

The indication that the lubricant constructions have at least one reproducibly controlled dimensions includes the use of a blend of two or more sets of pellets, each set of pellets varying in the size of the reproducibly controlled dimension(s).

A preferred shape of the product is a cylindrical pellet having a diameter of 2 mm and a length of no greater than 10 mm. Two most preferred embodiments are pellets having a diameter of 1.6 mm and a length of approximately 10 mm and pellets having a diameter of 1 mm and a length of approximately 5 mm.

Some representative examples follow:

EXAMPLES A–D

Representative dry wire drawing lubricants were prepared in a stirred reactor to a final temperature of 90 degrees Centigrade and formed into dust-free pellets on a roller extrusion press. The compositions are shown in the following Table I.

The roller extrusion press used in the experiment comprised a flat die plate having a plurality of 1 mm diameter perforations 3 mm in length. A series of two rollers moved transversely across the top openings of each of the perforations every 2 to 3 seconds. The rollers were suspended approximately 0.75 mm above the top surface of the die plates. The lubricant compositions of examples A through D were fed continuously into the space between the roller surface and the die plate. The lubricant composition was converted from essentially powder to continuous extruded strands through each die plate perforation. A breaker blade, rotating below the die plate and adjusted for distance from the die plate and speed of rotation controlled the length of each generated pellet. Thus, the extruded strands, 1 mm in diameter, were cut or chopped to a controlled length of approximately 7 mm average.

The water reported in Table I is used in the formulation to convert the metal oxides to metal hydroxides which in turn react with the fatty acids to form soaps. The additives are conventional fillers, thickeners, anti-corrosives, and the like.

TABLE I

DRY WIRE DRAWING SOAP COMPOSITION

| | Soluble Sodium Soaps (weight %): | | Insoluble Calcium Soaps (weight %): | |
|---|---|---|---|---|
| Example | Rich A | Lean B | Rich C | Lean D |
| Fatty Acid | 72 | 49 | 58 | 32 |
| Metal Oxide | 9 | 5.5 | 30 | 50 |
| Additives | 13 | 39.5 | 2 | 3 |
| Water | 6 | 6 | 10 | 15 |

It was found that the pelletized dust-free pulverizable dry wire drawing compounds of examples A through D could be pulverized back to powder by applying a force of approximately 20 pounds per square inch (psi). The pellets of examples A through D were sufficiently cohesive to resist breakage during packaging and shipping.

Evaluation of the pellets of examples A and C were carried out on production size wire drawing equipment. The results are shown in Table II. The "Controls" were the same lubricant compositions but in unpelletized form. With the insoluble calcium soap (example C), an additional 10 weight percent water was added at the pressure forming stage to produce pellets containing approximately 5 weight percent unreacted water after partial drying.

TABLE II

| | Example A: | Example C: |
|---|---|---|
| Type of Die | Stationary | Roller |
| # of Reductions | one | — |
| Wire Speed | 350 feet/min. | >1500 feet/min. |
| Lubrication Quality | equal to Control | equal to Control |
| Dust Generation: | | |
| for Pellets | none | none |
| for Control | copious | copious |

EXAMPLES E–F

A test was run to determine applicability of the process to reprocessing of "spent" material. Following some wire drawing operations, spent lubricant (a rich, soluble, sodium soap) was collected from the floor under the wire drawing machine and from the soap box, care being taken to exclude metal particles and non-soap products. The spent material was dusty and had an analysis similar to that of Example A above, except that the fatty acid content was about 77%, the metal oxides about 15%, the additives about 8%, and the water less than 1%. This material was repelletized on a 1 mm die, some as is (Example E) and some (Example F) mixed with virgin material (75% spent/25% virgin), the virgin material being about 79–81% fatty acid, about 10–13% metal oxide, about 4–6% additives, and less than 2% water. Pellets made from both materials showed positive lubrication results in a one hour evaluation.

EXAMPLE G

A series of evaluations were made to determine the strength of pellets produced according to this invention, "strength" referring to resistance to pulverization to powder where exposed to pressure between opposing platens in a machine (an Instron 4204 Tester) designed to evaluate physical properties of dry materials. The tests were run on pellets made from various rich and lean, sodium and calcium based, compositions, with diameters varying from 0.8 to 6.2 mm and lengths varying from 3.4 to 13.3 mm. The results in all cases showed that the pellets were resistant to pulverization at pressures below about 17 psi and were readily pulverized at pressures between about 17 psi and about 292 psi.

What is claimed is:

1. Shaped, dust-free dry wire drawing lubricants which are comprised of metal soaps and have a fatty acid content of at least about 30% by weight, have at least one reproducibly controlled dimension, and are pulverizable by the wire in wire drawing processes at a force between about 10 psi and about 300 psi into viscous lubricating films.

2. A shaped lubricant as in claim 1 which is in the form of a cylindrical pellet.

3. A shaped lubricant as in claim 2 wherein the pellet pulverizes readily at a force between about 20 psi and about 135 psi.

4. A shaped lubricant as in claim 2 wherein the pellet has a diameter of 1 to 2 mm and an average length of 5 to 10 mm.

5. A shaped lubricant as in claim 1 wherein the lubricant contains a sodium or calcium soap.

6. A method of providing wire with a uniform coating of lubricant during wire drawing which comprises pulling said wire, prior to drawing, continuously through a bed containing the shaped, dry wire drawing lubricant of claim 1.

7. A method as in claim 6 wherein some of the lubricant in the bed is in pulverized form.

8. A method of making shaped, dust-free dry wire drawing compounds which are comprised of metal soaps and have a fatty acid content of at least about 30% by weight, have at least one reproducibly controlled dimension, and are pulverizable by the wire in wire drawing processes at a force between about 10 psi and 300 psi into viscous lubricating films, which method comprises conglutinating and shaping the dry wire compound composition under controlled pressure.

9. A method as in claim 8 wherein the composition contains a sodium or calcium soap.

10. The method of claim 8 conducted in the presence of water.

11. A method as in claim 8 wherein the composition is conglutinated at a temperature of from about 50 to about 120 degrees Centigrade.

12. A method as in claim 8 wherein a roller extrusion press is employed to do the shaping.

13. A method as in claim 8 wherein the composition is comprised of spent wire drawing compounds.

14. Continuously moving wire having a uniform viscous film of lubricant thereon during wire drawing, which uniform viscous film results from pulling said wire prior to drawing through a bed containing the shaped, dry wire drawing lubricant of claim 1.

15. Shaped, dust-free dry wire drawing lubricants which are comprised of metal soaps, free of elemental tin, have at least one reproducibly controlled dimension, and are pulverizable by the wire in wire drawing processes at a force between about 10 psi and about 300 psi into viscous lubricating films.

* * * * *